US010151472B2

(12) United States Patent
Zeng et al.

(10) Patent No.: US 10,151,472 B2
(45) Date of Patent: Dec. 11, 2018

(54) LED STRIP LIGHT FOR SHELF SIGNBOARDS

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Guoqing Zeng, Zhejiang (CN); Yuanfang Xue, Zhejiang (CN); Jianguo Dong, Zhejiang (CN); Kai Xu, Zhejiang (CN); Fawei Zhang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/832,410

(22) Filed: Dec. 5, 2017

(65) Prior Publication Data

US 2018/0180276 A1 Jun. 28, 2018

(30) Foreign Application Priority Data

Dec. 22, 2016 (CN) ..... 2016 1 1194954

(51) Int. Cl.
*F21V 33/00* (2006.01)
*A47F 3/00* (2006.01)
(Continued)

(52) U.S. Cl.
CPC ..... *F21V 33/0012* (2013.01); *A47F 3/001* (2013.01); *A47F 5/0043* (2013.01);
(Continued)

(58) Field of Classification Search
CPC ..... F21V 33/0012; F21V 33/002; F21V 33/0048; F21S 4/20; A47F 3/001; A47F 5/0043; A47F 11/10
(Continued)

(56) References Cited

U.S. PATENT DOCUMENTS 5,508,898 A * 4/1996 McGovern ..... A47F 11/10 312/223.5
6,179,434 B1 * 1/2001 Saraiji ..... A47F 3/001 108/23

(Continued)

*Primary Examiner* — Daniel Hess
(74) *Attorney, Agent, or Firm* — Wang Law Firm, Inc.

(57) ABSTRACT

An LED strip light for shelf signboards, comprises a strip-shaped lamp chamber, and an LED light-emitting module. The strip-shaped lamp chamber comprises a card board connecting edge, a non-transparent edge, an upper transparent edge and a lower transparent edge. The upper transparent edge is parallel to the laminate. The LED light-emitting module comprises at least one LED chip, and a strip-shaped reflective device. The strip-shaped reflective device comprises a first reflective surface and a second reflective surface. The first reflective surface reflects all the incident lights thereon toward the upper light transparent edge. The second reflective surface reflects all the incident lights thereon toward the lower transparent edge. Due to the structure of the strip light chamber and the LED light-emitting module, the LED strip light for shelf signboards allows the first row of the article display side facing the customers which are placed on the laminate and the space below the laminate to be illuminated so as to improve the user's shopping experience.

10 Claims, 3 Drawing Sheets

(51) Int. Cl.

| | |
|---|---|
| ***A47F 11/10*** | (2006.01) |
| ***F21S 4/20*** | (2016.01) |
| ***A47F 5/00*** | (2006.01) |
| *F21W 131/301* | (2006.01) |
| *F21W 131/305* | (2006.01) |
| *F21W 131/405* | (2006.01) |

(52) U.S. Cl.
CPC ..... *A47F 11/10* (2013.01); *F21S 4/20* (2016.01); *F21V 33/002* (2013.01); *F21V 33/0048* (2013.01); *A47B 2220/0077* (2013.01); *F21W 2131/301* (2013.01); *F21W 2131/305* (2013.01); *F21W 2131/405* (2013.01)

(58) Field of Classification Search
USPC ..... 362/145
See application file for complete search history.

(56) References Cited

U.S. PATENT DOCUMENTS

| | | | | |
|---|---|---|---|---|
| 2009/0091271 | A1* | 4/2009 | Zulim | A47F 3/001 315/297 |
| 2013/0088136 | A1* | 4/2013 | Bassi | F25D 25/02 312/408 |
| 2015/0023000 | A1* | 1/2015 | Kendall | F25D 25/02 362/92 |
| 2016/0097516 | A1* | 4/2016 | Howard | G09F 3/204 362/98 |

* cited by examiner

LED STRIP LIGHT FOR SHELF SIGNBOARDS

RELATED APPLICATION

This application claims priority to a Chinese Patent Application No. 201611194954.6, filed on Dec. 22, 2016.

TECHNICAL FIELD

The present invention relates to lighting apparatus, with particular emphasis on an LED strip light for shelf signboards.

BACKGROUND OF THE INVENTION

In ordinary daily life, all kinds of lighting apparatus can be seen everywhere, such as fluorescent lamps, street lamps, table lamps, artistic lamps and so on. In the above-described lighting apparatus, the tungsten bulb is traditionally used as a light-emitting light source. In recent years, due to the ever-changing technology, light-emitting diode (LED) has been used as a light source. Moreover, in addition to lighting apparatus, for the general traffic signs, billboards, headlight etc., light-emitting diode (LED) has also been used as a light source. The light-emitting diode (LED) as a light source has the advantages of energy-saving and greater brightness. Therefore, it has been gradually common.

With the popularity of LED lamps, more and more occasions began to use LED strip light. For the increasingly common use of LED strip light, its installation has become the focus of attention. For supermarkets, shopping malls, museums, exhibition halls and other places, they need to use a large number of shelves to display the items, these shelves include at least two columns, arms erected in the column, and at least one laminate placed in the two arms. In actual use, the shelf will commonly set at least two laminates. The lighting between these laminates is generally from two directions of the light source, one is from the top of the light source of the buildings, such as supermarkets, shopping malls and so on, and another is from the underlying light source of each laminate. However, when the articles are placed on the laminates, the display side of the articles nearest the user can not always be highlighted, the light of the display side is the same as the light obtained from the other sides. It is difficult to enhance the user's desire to buy. And the side of the laminate near the column is often blocked by the laminate, so it is relatively dark, which will reduce the customers lighting experience, and if lamps are also installed on the side of the laminate near the column, it will increase costs and waste energy.

Therefore, it is necessary to provide an LED strip light for shelf signboards which can make the articles on the laminate to get accent illumination and also fill light in the space below the laminate and the LED strip light for shelf signboards can meet the above requirements.

BRIEF SUMMARY OF THE INVENTION

An LED strip light for shelf signboards, the shelf comprising at least one laminate which comprises one card board for setting the LED strip light for shelf signboards, characterized in that comprising a strip-shaped lamp chamber and an LED light-emitting module disposed within the strip-shaped lamp chamber, on a cross-section perpendicular to the extending direction of the strip-shaped lamp chamber, the strip-shaped lamp chamber comprising a card board connecting edge for connecting the card board, a non-transparent edge spaced from the card board connecting edge, an upper transparent edge connecting the card board connecting edge and the non-transparent edge, a lower transparent edge connecting the card board connecting edge and the non-transparent edge and spaced from the upper transparent edge, the upper transparent edge being parallel to the laminate, the length of the card board connecting edge being less than that of the non-transparent edge, the LED light-emitting module which is provided on the card board connecting edge comprising at least one LED chip, and a strip-shaped reflective device arranged in the light emitting direction of the LED chip, on a cross-section perpendicular to the extending direction of the strip-shaped lamp chamber the strip-shaped reflective device comprising a first reflective surface and a second reflective surface and a boundary line between the first reflective surface and the second reflective surface, the first reflective surface reflecting all the light thereon toward the upper light transparent edge, the second reflective surface reflecting all the light thereon toward the lower transparent edge, the boundary line intersecting the optical axis of the LED chip.

Further, on the cross-section perpendicular to the extending direction of the strip-shaped lamp chamber the optical axis of the LED chip is parallel to the upper transparent edge.

Further, on the cross-section perpendicular to the extending direction of the strip-shaped lamp chamber the card board connecting edge is arranged in parallel to the non-transparent edge.

Further, two reflective device slots are provided on the non-transparent edge and the reflective device slots are spaced from each other.

Further, the LED light-emitting module further comprises a circuit board for setting the LED chip, and two L-Shaped slots are provided on the card board connecting edge for inserting the circuit board.

Further, on the cross-section perpendicular to the extending direction of the strip-shaped lamp chamber the LED light-emitting module is arranged in the middle of the card board connecting edge.

Further, the strip-shaped lamp chamber further comprises two U-shaped slots spaced from each other which are provided on the non-transparent edge, and the strip-shaped reflective device is inserted in the two U-shaped slots.

Further, on the cross-section perpendicular to the extending direction of the strip-shaped lamp chamber the length of the first reflective surface is less than that of the second reflective surface.

Further, the LED strip light for shelf signboards further comprises an optical diffuser film arranged between the upper transparent edge and the LED lighting module which are provided in the strip-shaped lamp chamber.

Further, the strip-shaped reflective device is spaced from the LED chip.

Compared with the prior art, since the LED strip light for shelf signboards in the present invention has the structure of the strip light chamber and the LED light-emitting module, the LED strip light for shelf signboards allows the first row of the article display side facing the customers which are placed on the laminate and the space below the laminate to be illuminated so as to improve the user's shopping experience.

BRIEF DESCRIPTION OF THE DRAWINGS

The drawings described herein are intended to promote a further understanding of the present invention, as follows.

DETAILED DESCRIPTION OF THE INVENTION

The present application is illustrated by way of the following detailed description based on of the accompanying drawings. It should be noted that illustration to the embodiment in this application is not intended to limit the invention.

Figure 1:
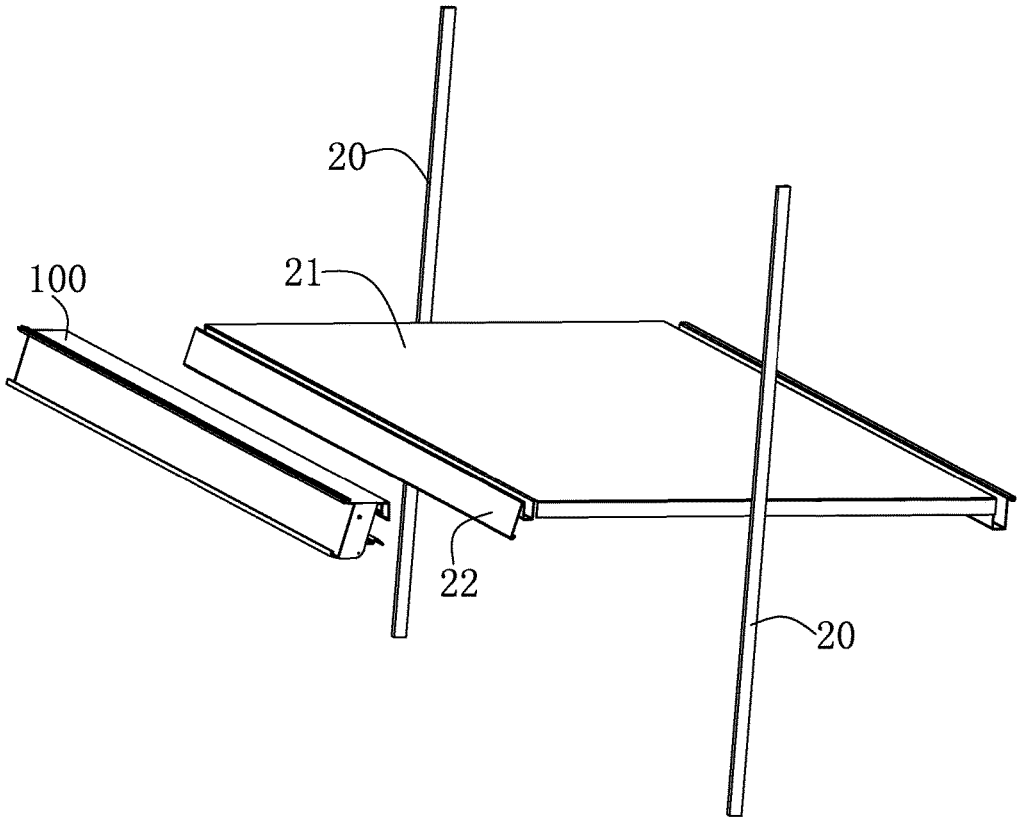
FIG. 1 is a schematic view of an exploded structure of the LED strip light for shelf signboards provided by the present invention.
Figure 2:
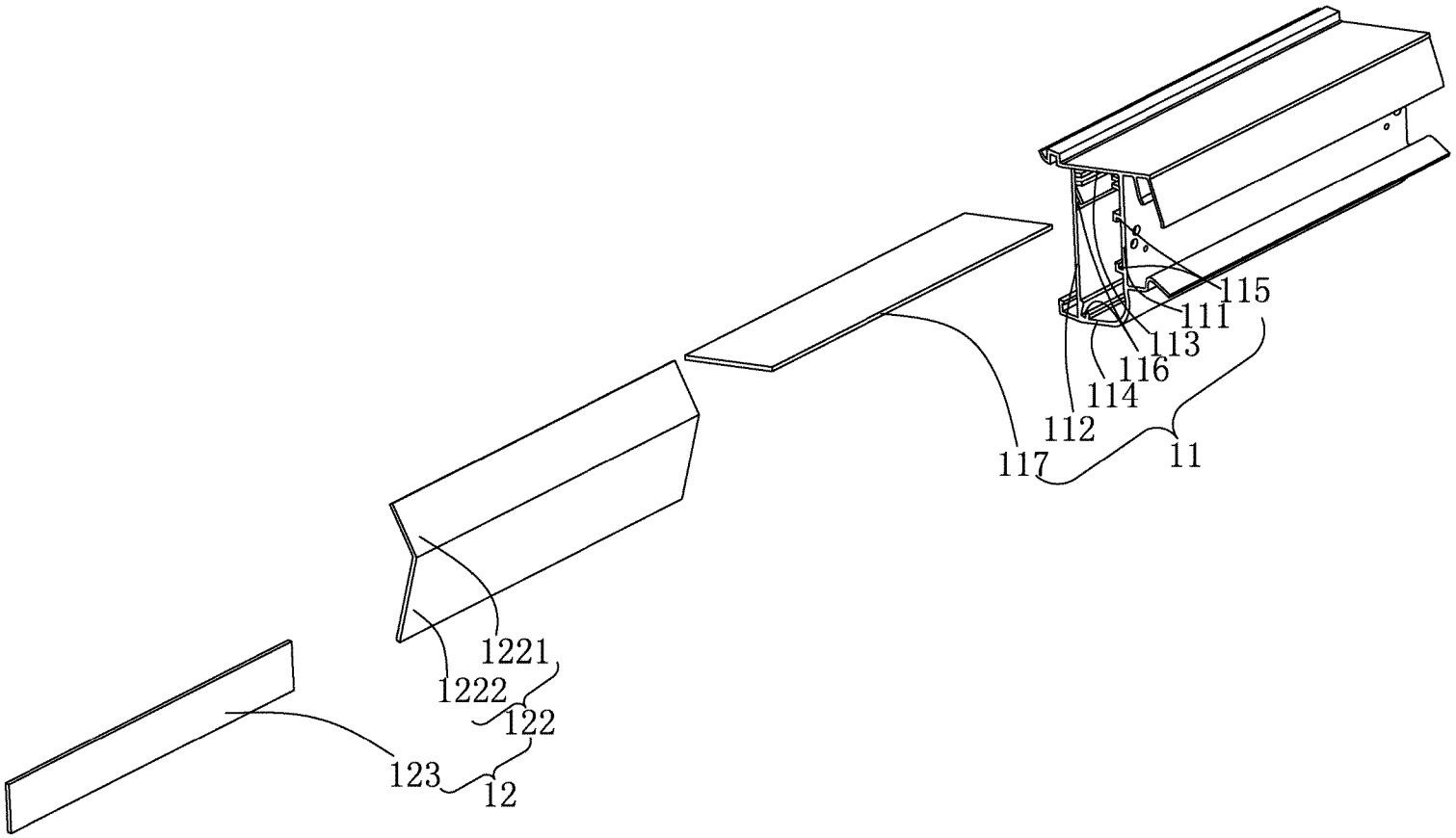
FIG. 2 is a schematic exploded view of the LED strip light for shelf signboards of FIG. 1.
Figure 3:
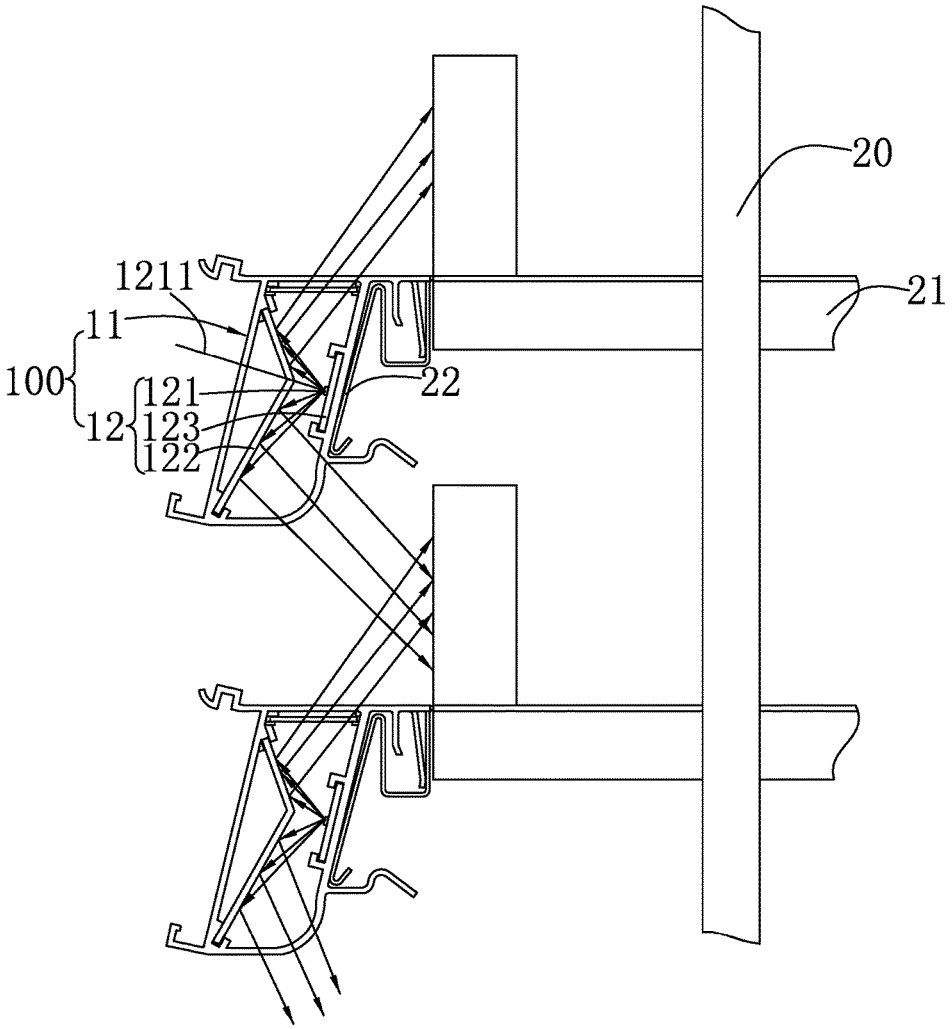
FIG. 3 is a schematic view of the optical path of the LED strip light for shelf signboards of FIG. 1.

Please referring to FIG. 1 to FIG. 3, FIG. 1 is a schematic view of an exploded structure of the LED strip light 100 for shelf signboards provided by the present invention. At first the basic structure of the shelf for the LED strip light for shelf signboards needs to be described. The shelf as a prior art, is widely used in shopping malls, supermarkets, museums and other exhibitions. Typically, the shelf comprises at least two columns 20 and at least one laminate 21 disposed on the two columns 20. Each of the laminates 21 comprises a card board 22 for setting the LED strip light 100 for shelf signboards. Meanwhile, in order to facilitate the user to view the signboards, on a cross-section perpendicular to the extending direction of the LED strip light 100 for shelf signboards, the angle between the card board 22 and the laminate 21 is obtuse rather than vertical. The obtuse angle can be less than 105 degrees or can also be set according to actual requirements. The LED strip light 100 for shelf signboards comprises a strip-shaped lamp chamber 11 and an LED light-emitting module 12 disposed within the strip-shaped lamp chamber 10. It is also to be noted that the LED strip light 100 for shelf signboards also further comprises a signboard plug assembly (not shown) for inserting signboards and a buckle assembly (not shown) used for the LED strip light 100 for shelf signboards which can be mounted on the card board 22. The strip-shaped lamp chamber 11 is provided between the signboard plug assembly and the buckle assembly. It is contemplated that the LED strip light 100 for shelf signboards also comprises other functional modules such as end caps, drive power and the like. The above-mentioned functional modules are not intended to be the focus of the present invention and will not be described in detail herein. On the cross-section perpendicular to the extending direction of the strip-shaped lamp chamber 11, the strip-shaped lamp chamber 11 comprises a card board connecting edge 111 for connecting the card board 22, a non-transparent edge 112 spaced from the card board connecting edge 111, an upper transparent edge 113 connecting the card board connecting edge 111 and the non-transparent edge 112, a lower transparent edge 114 connecting the card board connecting edge 111 and the non-transparent edge 112 and spaced from the upper transparent edge 113, the card board connecting edge 111 is used for connecting the card board 22, i.e., the strip-shaped lamp chamber 11 is provided on the card board 22. The shape of the card board connecting edge 111 should be the same as that of the card board 22 so that the card board connecting edge 111 can be attached to the card board 22. In the present embodiment, the card board 22 is a flat plate, so the card board connecting edge 111 is also a flat plate. When the card board 22 is wavy or corrugated, the card board connecting edge 111 should be formed in a wavy shape or a corrugated shape. The two L-shaped slots 1111 are provided for setting the LED light-emitting module 12, and the structure thereof will be described in detail below. The non-transparent edge 112 is also used to set up the signboard plug assembly. The non-transparent side 112 is parallel to the card board connecting edge 111 so as to facilitate the user to view the signboards. The length of the non-transparent edge 112 is greater than the length of the card board connecting edge 111. The angle between the side of the upper transparent edge 113 towards the outside of the strip-shaped lamp chamber 11 and the laminate 21 is 180 degrees so that the side of the upper transparent edge 113 towards the outside of the strip-shaped lamp chamber 11 is parallel to the laminate 21, and it will be beautiful. Also because the side of the upper transparent edge 113 towards the outside of the strip-shaped lamp chamber 11 is parallel to the laminate 21, the sides of the non-transparent edge 112 and the card board connecting edge 111 located on the upper transparent edge 113 are flush, while the sides of the non-transparent edge 112 and the card board connecting edge 111 located on the lower transparent edge 114 are staggered. Since the sides of the non-transparent edge 112 and the card board connecting edge 111 located on the lower transparent edge 114 are staggered, the overall shape of the lower transparent edge 114 is not parallel to the laminate 21. The lower transparent edge 114 can be an arcuate, L-shaped structure or hypotenuse which connects the end of the non-transparent edge 112 and the card board connecting edge 111. In the present embodiment, the lower transparent edge 114 is arcuate. Due to the presence of the arcuate lower transparent edge 114, the light can be emitted from the lower transparent edge 114 and emitted to the articles placed on the next laminate 21 or illuminate the internal space between the two laminates 21.

The LED light-emitting module 12 comprises at least one LED chip 121, a strip-shaped reflective device 122 arranged in the light emitting direction of the LED chip 121, a circuit board 123 for setting the LED chip 121. The LED chip 121 is a light-emitting diode known to those skilled in the art, and the specific structure and working principle thereof will not be described here. It can be understood that each LED chip 121 comprises an optical axis 1211. Although the optical axis 1211 or the optical axis surface is a virtual geometric feature, it is essential as an optical design guide. The optical axis 1211 is generally located at the center of the LED chip 121 or the optical axis surface is on the symmetry line of the LED chip 121. In the present embodiment, the optical axis 1211 is vertical to the card board connecting edge 111. On the cross-section perpendicular to the extending direction of the strip-shaped lamp chamber 11 the strip-shaped reflective device 122 comprises a first reflective surface 1221 and a second reflective surface 1222 and a boundary line 1223 between the first reflective surface 1221 and the second reflective surface 1222, the first reflective surface receives the light emitted from the LED chip 121, and reflects all emergent light thereon toward the upper transparent edge 113. The second reflective surface 1222 receives the light emitted from the LED chip 121, and reflects all emergent light toward the lower transparent edge 114. On the cross-section perpendicular to the extending direction of the strip-shaped lamp chamber the length of the first reflective surface 1221 is less than that of the second reflective surface 1222, which is determined by the structure of the strip-shaped lamp chamber 11, that is, the length of the non-transparent edge 112 is greater than the length of the card board connecting edge 111. The distance between the strip-shaped reflective device 122 and the LED chip 121 is determined by the light spot size that the first and second reflective surfaces 1221 and 1222 require, that is, the light intensity of the LED strip light 100 for shelf signboards. In the limiting case, the first reflective surface 1221 clings to the LED chip 121, and at this time, the required light intensity is the strongest, and most of the LED chip 121 are also needed. In the present embodiment, the strip-shaped reflective device 122 is spaced from the LED chip 121. The boundary line 1223 intersects the optical axis 1211 so that one half of the light of the LED chip 121 enters one side of the boundary line 1223 and the other half of the light enters the other side of the boundary line 1223.

The optical path principle of the strip-shaped reflective device 122 will be described below. The first reflective surface 1221 receives the incident light from the LED chip 121 and reflects it to the upper transparent edge 113. Since the emergent light from the LED chip 121 is dispersed between 0 and 180 degrees on the cross section perpendicular to the extending direction of the strip-shaped lamp chamber 11, when the LED chip 121 is spaced from strip-shaped reflective device 122, the angle between the incident light of the boundary line 1223 and optical axis 1211 is within 90 degrees. Then, according to the reflection principle, the angle between the emergent light of the first reflective surface 1221 and the upper transparent edge 113 is also within 90 degrees, so that the emergent light of the first reflective surface 1221 can illuminate the display side of the row of articles placed on the laminate 21 nearest the user, the pattern and the character on the article display side can be illuminated to achieve the purpose of accent illumination. The second reflective surface 1222 receives part of the incident light from the LED chip 121 and reflects it to the lower transparent edge 114. The emergent light will be emitted to the top or the display side of the articles placed on the other laminate 21, and further illuminate articles or the display side of the articles placed on the another laminate 21 to achieve the purpose of accent illumination.

The circuit board 123 may be a printed circuit board (PCB) on which a circuit or other electronic component such as a diode, a transistor, or the like is provided to give the LED chip 121 a current or control signal.

The LED light-emitting module 12 is arranged on the card connecting edge 111 and the non-transparent edge 112 of the strip-shaped lamp chamber 11. On the across-section perpendicular to the extending direction of the strip-shaped lamp chamber 11, the strip-shaped lamp chamber 11 further comprises two L-shaped slots 115 spaced from each other which are provided on the card board connecting edge 111, and two U-shaped slots 116 spaced from each other which are provided on the non-transparent edge 112. The L-shaped slot 115 is used for inserting the circuit board 123. The U-shaped slot 116 is used for inserting the strip-shaped reflective device 122 so as to achieve the aim to fixing the LED light-emitting module 12.

The lamp chamber 11 may also comprise an optical diffusion film 117. The optical diffusion film 117 is located between the LED light emitting module 12 and the upper transparent edge 113. Since the LED chip 121 is provided on the circuit board 123 in a granular manner. And the strip-shaped reflective device 122 is transparent, so that the user can see a single point light source from the upper transparent edge 113, thereby affecting the user's photographic experience. In order to avoid such a situation, the optical diffusion film 117 is used for dispersing the light directed toward the upper transparent edge 113 to avoid the effect of the point light source as far as possible. The optical diffusion film 117 is a prior art, and its structure and working principle are not described in detail herein. Specifically, each slot (not shown) is respectively provided on the card board connecting edge 111 and the non-transparent side 112, and then the optical diffusion film 117 is inserted in the slots to achieve the aim of installing the optical diffusion film 117.

Compared with the prior art, since the LED strip light for shelf signboards in the present invention has the structure of the strip-shaped lamp chamber 11 and the LED light-emitting module 12, the LED strip light for shelf signboards allows the first row of the article display side facing the customers which are placed on the laminate 21 and the space below the laminate to be illuminated so as to improve the user's shopping experience.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. An LED strip light for shelf signboards, the shelf comprising at least one laminate which comprises one card board for setting the LED strip light for shelf signboards, characterized in that comprising:

a strip-shaped lamp chamber and an LED light-emitting module disposed within the strip-shaped lamp chamber, on a cross-section perpendicular to the extending direction of the strip-shaped lamp chamber, the strip-shaped lamp chamber comprising a card board connecting edge for connecting the card board, a non-transparent edge spaced from the card board connecting edge, an upper transparent edge connecting the card board connecting edge and the non-transparent edge, a lower transparent edge connecting the card board connecting edge and the non-transparent edge and spaced from the upper transparent edge, the upper transparent edge being parallel to the laminate, the length of the card board connecting edge being less than that of the non-transparent edge, the LED light-emitting module which is provided on the card board connecting edge comprising at least one LED chip, and a strip-shaped reflective device arranged in the light emitting direction of the LED chip, on the cross-section perpendicular to the extending direction of the strip-shaped lamp chamber the strip-shaped reflective device comprising a first reflective surface and a second reflective surface and a boundary line between the first reflective surface and the second reflective surface, the first reflective surface reflecting all the light thereon toward the upper light transparent edge, the second reflective surface reflecting all the light thereon toward the lower transparent edge, the boundary line intersecting the optical axis of the LED chip.

2. The LED strip light for shelf signboards as claimed in claim 1, wherein on the cross-section perpendicular to the extending direction of the strip-shaped lamp chamber the optical axis of the LED chip is parallel to the upper transparent edge.

3. The LED strip light for shelf signboards as claimed in claim 1, wherein on the cross-section perpendicular to the extending direction of the strip-shaped lamp chamber the card board connecting edge is arranged in parallel to the non-transparent edge.

4. The LED strip light for shelf signboards as claimed in claim 1, wherein two reflective device slots are provided on the non-transparent edge and the reflective device slots are spaced from each other.

5. The LED strip light as claimed in claim 1, wherein the LED light-emitting module further comprises a circuit board for setting the LED chip, and two L-Shaped slots are provided on the card board connecting edge for inserting the circuit board.

6. The LED strip light for shelf signboards as claimed in claim 1, wherein on the cross-section perpendicular to the extending direction of the strip-shaped lamp chamber the LED light-emitting module is arranged in the middle of the card board connecting edge.

7. The LED strip light for shelf signboards as claimed in claim 1, wherein the strip-shaped lamp chamber further comprises two U-shaped slots spaced from each other which are provided on the non-transparent edge, and the strip-shaped reflective device is inserted in the two U-shaped slots.

8. The LED strip light for shelf signboards as claimed in claim 1, wherein on the cross-section perpendicular to the extending direction of the strip-shaped lamp chamber the length of the first reflective surface is less than that of the second reflective surface.

9. The LED strip light for shelf signboards as claimed in claim 1, wherein the LED strip light for shelf signboards further comprises an optical diffuser film arranged between the upper transparent edge and the LED light-emitting module which are disposed within the strip-shaped lamp chamber.

10. The LED strip light for shelf signboards as claimed in claim 1, wherein the strip-shaped reflective device is spaced from the LED chip.

* * * * *